US006237171B1

(12) United States Patent
Allen

(10) Patent No.: US 6,237,171 B1
(45) Date of Patent: May 29, 2001

(54) BEDSHEET AND BLANKET COMBINATION FOR ACCOMADATING DIFFERING SLEEPER PREFERENCES

(76) Inventor: Mardi Allen, 2201 Rockbrook Dr. Apt. 238, Lewisville, TX (US) 75067

( * ) Notice: Subject to any disclaimer, the term of this patent is extended or adjusted under 35 U.S.C. 154(b) by 0 days.

(21) Appl. No.: 09/227,676

(22) Filed: Jan. 8, 1999

(51) Int. Cl.[7] ..... A47G 9/00

(52) U.S. Cl. ..... 5/482; 5/485; 5/486; 5/496; 5/500; 5/501

(58) Field of Search ..... 5/482, 485, 486, 5/494, 496, 498, 500–502, 501

(56) References Cited

U.S. PATENT DOCUMENTS

| | | | | |
|---|---|---|---|---|
| 3,072,776 | * | 1/1963 | Quenneville | 5/486 X |
| 4,069,526 | * | 1/1978 | Deikel | 5/486 |
| 5,023,969 | * | 6/1991 | Nattrass | 5/486 |
| 5,408,712 | * | 4/1995 | Brun | 5/502 |
| 5,566,411 | * | 10/1996 | Eiler | 5/494 |
| 5,732,424 | * | 3/1998 | Bond | 5/502 |

FOREIGN PATENT DOCUMENTS

| | | | | |
|---|---|---|---|---|
| 2229086 | * | 9/1990 | (GB) | 5/413 X |

* cited by examiner

*Primary Examiner*—Terry Lee Melius
*Assistant Examiner*—James M Hewitt
(74) *Attorney, Agent, or Firm*—Roy A. Ekstrand

(57) ABSTRACT

A bedsheet and blanket combination includes a generally planar undersheet sized to be rested upon an otherwise conventional mattress together with a pocket cover sized to cover approximately half of the undersheet. The pocket cover is joined along three sides to the underlying portion of the undersheet to form a pocket having an open portion. The open portion may be provided at the top, bottom, outer side, or inner side of the pocket cover. A blanket formed of a insulative material is removably received within the pocket by insertion through the pocket opening. During laundering, the blanket is removed from the pocket leaving the pocket cover and undersheet to be easily washed in accordance with conventional laundering techniques. In alternate embodiments shown, a second pocket is provided which facilitates independent blanket support upon the undersheet to accommodate user preferences.

11 Claims, 2 Drawing Sheets

BEDSHEET AND BLANKET COMBINATION FOR ACCOMADATING DIFFERING SLEEPER PREFERENCES

FIELD OF THE INVENTION

This invention relates generally to covering devices for beds and particularly to those which accommodate a difference in temperature preference and degree of covering between two persons sharing a common bed.

BACKGROUND OF THE INVENTION

A situation often arises in sleeping environments in which two people share a common bed and in which the two people have decidedly different preferences in the extent of bed covering for warmth, etc. This situation is perhaps best described as differences in temperature preference between such sleepers in a common bed. Often, one partner prefers cooler temperature (therefore fewer blankets) while the other prefers warmer temperatures (therefore more blankets). In a standard double bed, queen size or king size arrangement suitable for use by two persons simultaneously, an undersheet is placed upon the upper surface of the mattress and is somehow folded under or secured thereto. Often, the undersheet is a so-called fitted sheet which defines side portions which constrict about the mattress periphery. An upper sheet overlies the undersheet and the user's typically sleep between the undersheet and upper sheet. In most instances, one or more blankets are then laid upon the upper sheet for the desired warmth. In a standard bed arrangement, the sheets serve a very practical function in that the upper and lower sheets are the only portion which touches the sleeper's body. As a result, replenishing the bed for other users is a simple matter of washing the sheets and pillow cases while leaving the blankets as they are. Over time, the sheets are repeatedly washed while the blankets may be washed from time to time. This situation is preferred due to the difficulty associated with washing blankets. The term blanket used in this application will be understood to embrace any of a number of blankets, comforters and quilts utilized for providing thermal insulation for sleeping persons. As a result, the term blanket embraces conventional blankets, knitted blankets, various types of comforters and quilts or the like. Such blankets and similar materials are often "dryclean-only" type materials. Those which are washable are exceedingly difficult to handle and require extended drying and so on.

The differences in temperature preference between sleepers means that one sleeper desires fewer blankets and coverings while the other desires more. Many times sleepers attempt to distribute blankets upon the bed as half coverings to accommodate this diversity. In addition, electric blankets which utilize relatively thin blankets having electrically powered heating coils therein are often provided with dual controls allowing each user to separately adjust the degree of heating in one side of the bed. While such dual control zone type electric blankets are able to provide accommodation of temperature preferences between sleepers, a great number of people prefer not to use an electric blanket for various reasons. As a result, the need in the art for effective bedsheet and blanket combinations for accommodating diverse sleeper preferences is substantial. In response to this substantial need, practitioners in the art have attempted to provide satisfactory practical and effective bedsheet and blanket combinations.

For example, U.S. Pat. No. 5,287,573 issued to Ritacco sets forth a pair of color-coordinated fitted bedsheets positioned overlying a bed in which each sheet is composed of a flannel material and a cotton-polyester blend material joined into two halves running along their respective lengths. The flannel half sheets are preferable for those desiring warmth during cooler months of the years while the cotton polyester blend half sheets are preferable for use by their bed partner desirable a cooler feeling.

U.S. Pat. No. 5,199,121 issued to Payne sets forth an ADJUSTABLE FILL COMFORTER having an outer fabric shell and a fill of down or down-like material. A top panel and a bottom panel are formed about the periphery of the envelope and facilitate the shifting of fill material between one portion of the comforter and another.

U.S. Pat. No. 4,802,251 issued to O'Dell sets forth a TOP AND BOTTOM BED-SHEETING COMBINATION being coupled along one or more edges tending to maintain reasonable order and neatness of the bed linens at the side and/or foot portion of the bed. An embodiment is shown for a double bed which provides a central entry of a person between the coupled sheets.

Additional early attempts at solving the temperature difference preferences between common bed sleepers are set forth in U.S. Pat. No. 3,072,776 issued to Quennville and entitled BED COVERING; U.S. Pat. No. 3,331,088 issued to Marquette and entitled BLANKET WITH CHANGEABLE THICKNESS VARYING PANELS; U.S. Pat. No. 3,508,285 issued to Marquette and entitled BLANKETS WITH MULTIPLE PANELS OF VARYING WARMTH CHARACTERISTICS and U.S. Pat. No. 3,530,516 issued to Marquette and entitled BLANKET WITH INTERCHANGEABLE HALVES.

While the various prior art devices directed to the problem of thermal preferences between sleepers have improved the art generally and in some instances enjoyed commercial success, there remains nonetheless a continuing need in the art for apparatus which more effectively and more efficiently solves the thermal difference preference problem in an easier to use system.

SUMMARY OF THE INVENTION

Accordingly, it is a general object of the present invention to provide an improved bedsheet and blanket combination. It is a more particular object of the present invention to provide an improved bedsheet and blanket combination for accommodating differing sleeper preferences in a common bed. It is a still more particular object of the present invention to provide an improved bedsheet and blanket combination for accommodating differing sleeper preferences which avoids the need to repeatedly launder the blanket or blanket portions thereof.

In accordance with the present invention, there is provided in a bed having a sleeping surface for use by two persons, a bedsheet and blanket combination comprising: a generally planar undersheet formed of a bedsheet material; a pocket cover overlying substantially one-half of the undersheet, the pocket cover and the undersheet being joined to form a three-sided pocket having a blanket opening therein; and a blanket having a size and shape facilitating insertion of the blanket through the opening into the pocket, the blanket and the pocket extending over approximately one-half of the undersheet and covering one of two persons sleeping in a bed.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
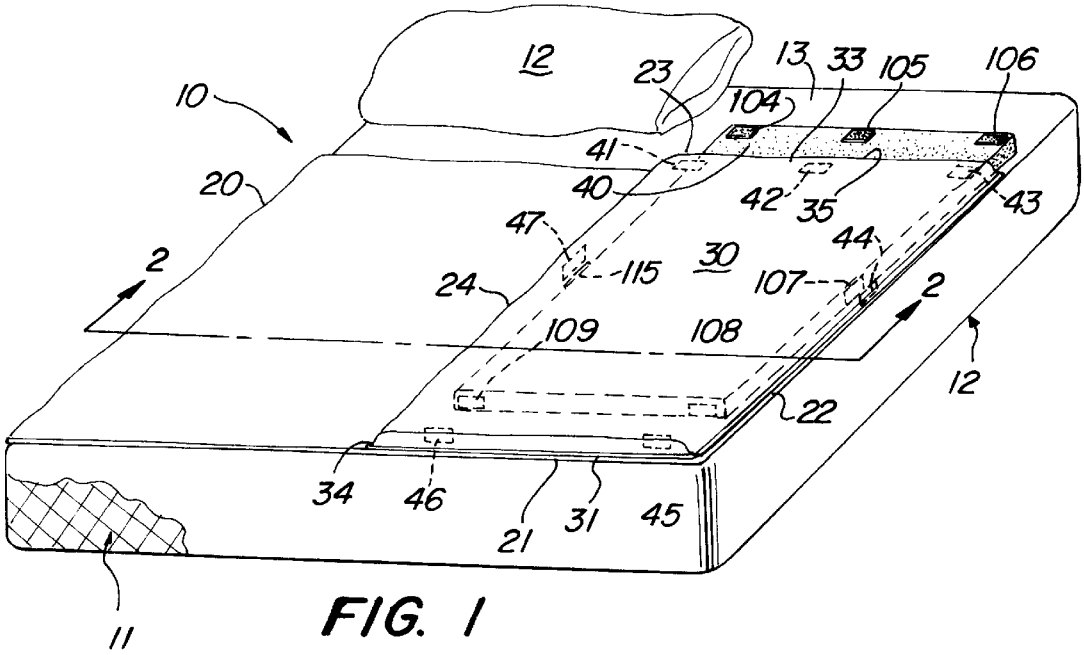
FIG. 1 sets forth a perspective view of a bed supporting a bedsheet and blanket combination constructed in accordance with the present invention.

FIG. 1 sets forth a perspective view of a bedsheet and blanket combination constructed in accordance with the present invention and generally referenced by numeral 10. Bedsheet and blanket combination 10 is shown positioned upon a mattress 11 having a fitted sheet 12 secured thereto and having an upper surface 13. Mattress 11 and fitted sheet 12 may be fabricated in accordance with conventional fabrication techniques. In the anticipated use of the sleeping environment shown in FIG. 1, the sleeper or sleepers lie upon surface 13 of fitted sheet 12.

Bedsheet and blanket combination 10 includes an undersheet 20 formed of a conventional bedsheet material or the like of a conventional bedsheet material or the like resting upon surface 13. Undersheet 20 extends virtually the entire width of surface 13 and defines a bottom edge portion 21, a side edge portion 22 and an upper edge portion 23. In accordance with the present invention, bedsheet and blanket combination 10 further includes a pocket cover 30 preferably formed of a similar material to undersheet 20 and having a width one-half the width of undersheet 20. In further accordance with the present invention, pocket cover 30 is secured to undersheet 20 using conventional attachments such as sewn seams or the like to form edge portion 34 of pocket cover 30 and edge joint 24 between undersheet 20 and pocket cover 30. Pocket cover 30 further defines a lower edge 31, a side edge 32 and an upper edge 33. In further accordance with the present invention, pocket cover 30 is secured along edges 31 and 32 which together with edge 34 forms a pocket upon the upper surface of undersheet 20 (surface 13). In the embodiment shown in FIG. 1, upper edge 33 of pocket cover 30 is not secured to surface 13 of undersheet 20. As a result, an opening 35 is formed at the upper edge of pocket cover 30 allowing an elongated rectangular blanket 40 to be inserted into pocket 36 formed between pocket cover 30 and surface 13 of undersheet 20.

Pocket cover 30 further includes a plurality of fasteners 41, 42 and 43 along upper edge 33 together with fasteners 44 and 47 on each side of pocket cover 30 and fasteners 45 and 46 on the bottom of pocket cover 30. Correspondingly, blanket 40 includes fasteners 104, 105 and 106 cooperating with fasteners 41, 42 and 43. Blanket 40 further includes fasteners 107 and 115 cooperating with fasteners 44 and 47 of pocket cover 30. Finally, blanket 40 includes fasteners 108 and 109 cooperating with fasteners 45 and 46 of pocket cover 30. The function of the cooperating fasteners on blanket 40 and the interior surface of pocket cover 40 secures and maintains blanket 40 within pocket cover 30. The fasteners used for pocket cover 30 and blanket 40 set forth above include cooperating pairs of conventional fasteners such as snap-connectors, hook and loop fabric pads, buttons or equivalent fasteners capable of releasible attachment between blanket 40 and pocket cover 30.

For purposes of illustration of the operation of the present invention bedsheet and blanket combination, a typical pillow 12 is shown supported upon the head portion of mattress 11 with the understanding that an additional pillow would typically be found upon the remaining side of mattress 11 at the head portion once blanket 40 has been fully inserted. It will be apparent to those skilled in the art that the entire structure of bedsheet and blanket combination 10 is readily capable of multiple orientations upon fitted sheet 12. For example, rotation of the entire bedsheet and blanket combination for one half of a full rotation operates to reverse the relative positions of the uncovered portion of undersheet 20 and pocket cover 30 with its supported blanket 40. In such case, an additional change is the location of opening 35 of pocket 36 along the bottom edge of the bedsheet and blanket combination. Thus, it will be apparent that multiple positions and rotations of position are within the contemplated use of the present invention bedsheet and blanket combination. It should also be noted that the joining of the various edges and sheet portions forming bedsheet and blanket combination 10 is subject to choice from among the conventional attachment forms such as sewn seams, hook and loop fabric attachments, zippers, snap-fittings, or adhesives to name a few.

In operation, bedsheet and blanket combination 10 is placed upon fitted sheet 12 at a selected position and a thickness for blanket 40 is selected. Blanket 40 is insertable and removable with respect to pocket 36. As a result, one or more blankets having the desired thickness and warmth characteristics may be positioned within pocket 36 to provide substantially greater warmth for the persons sleeping beneath pocket cover 30, blanket 40 and undersheet 20. Conversely, the person sleeping on the remaining portion of fitted sheet 12 is covered solely by undersheet 20.

In accordance with an important aspect of the present invention, blanket 40 is entirely and easily removed from pocket 36 leaving the combination of undersheet 20 and pocket cover 30 to be easily and efficiently washed in the same manner as the user normally washes or launders bedsheets. As a result of blanket 40 being entirely surrounded within pocket 36, the blanket is not subjected to contact with the sleeper's body and is therefore maintained in a substantially clean condition despite multiple uses and different individuals sleeping in the bed. Further, the removable support of blanket 40 assures that the blanket need not be laundered with the remainder of bedsheet and blanket combination 10 thereby saving a substantial effort, difficulty and cost which would otherwise be incurred if blanket 40 needed to be washed or laundered along with the remainder of bedsheet and blanket combination 10.

Figure 2:
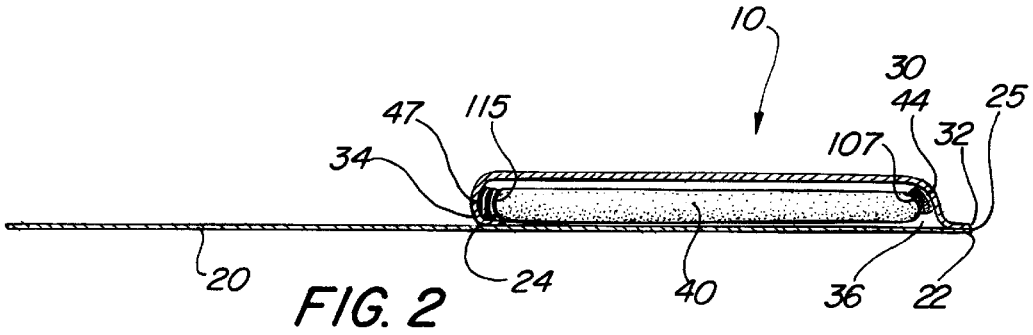
FIG. 2 sets forth a section view of the combination bedsheet and blanket of FIG. 1 taken along section lines 2—2 therein.

FIG. 2 sets forth a section view of bedsheet and blanket combination 10 taken along section lines 2—2 in FIG. 1. For purposes of clarity and to avoid undue cluttering of the drawing, FIG. 2 omits the section view of mattress 11 and fitted sheet 12. As described above, bedsheet and blanket combination 10 includes a generally planar undersheet 20 formed of a conventional material utilized in fabricating conventional bedsheets. Undersheet 20 defines an outer edge 22 which is joined to outer edge 32 of a pocket cover 30. Pocket cover 30 is similar fabricated of a conventional bedsheet material or other selected fabric and defines an edge 34 joined to the underlying portion of undersheet 20 to form a joint edge 24 with undersheet 20. Once again, it will be understood that the attachment of edge portions such as edge portions 22 and 32 forming joint 25 and edge portions 24 and 34 may be provided using a variety of conventional attachment mechanisms such as those referred to above. Pocket cover 30 is sufficiently spaced from undersheet 20 to form a pocket 36 within which blanket 40 is received as set forth above. It will be understood by those skilled in the art that undersheet 20 supporting pocket 36 and blanket 40 is normally positioned upon the person's sleeping within the host bed. Blanket 40 be fabricated using virtually any flexible insulative blanket material of the type readily known in the art. Also shown are cooperating fasteners 44 and 107 as well as fasteners 47 and 115.

Figure 3:
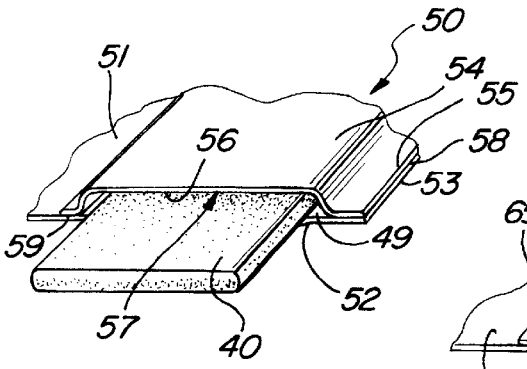
FIG. 3 sets forth a partial perspective view of an alternate embodiment of the present invention bedsheet and blanket combination which provides for insertion of the blanket portion from the bottom end of the bedsheet portion.

FIG. 3 sets forth a partial perspective view of an alternate embodiment of the present invention generally referenced by numeral 50. Bedsheet and blanket combination 50 is substantially identical to bedsheet and blanket combination 10 with the exception of having the blanket insertion opening positioned along the bottom edge of the combination. Thus, in blanket and bedsheet combination 50, an undersheet 51 substantially identical to undersheet 20 (seen in FIG. 1) and pocket cover 30 (also seen in FIG. 1) form a combination virtually identical to combination 10 seen in FIG. 1 with the difference being the provision of an opening 57 within which a blanket 40 may be inserted in pocket 49. Accordingly, edges 52 and 56 of undersheet 51 and pocket cover 54 are not joined and thus are freely openable. The remaining edge of undersheet 51 and pocket cover 54 are joined to form the remainder of the pocket in a three-side attachment as described above. Thus, for example, edges 53 and 55 of undersheet 51 and pocket cover 54 respectively are joined by conventional attachment such as sewing or the like to form a joint 58. A joint 59 upon the interior side of pocket cover 54 also joins pocket cover 54 to undersheet 51.

In the embodiment of FIG. 3, the resulting edge sheet and blanket combination enjoys all the advantages of the combination set forth in FIG. 1. Once again, blanket 40 is fully and easily removable from pocket 49 allowing undersheet 51 and pocket cover 54 to be laundered in a conventional manner without the need for laundering blanket 40.

Figure 4:
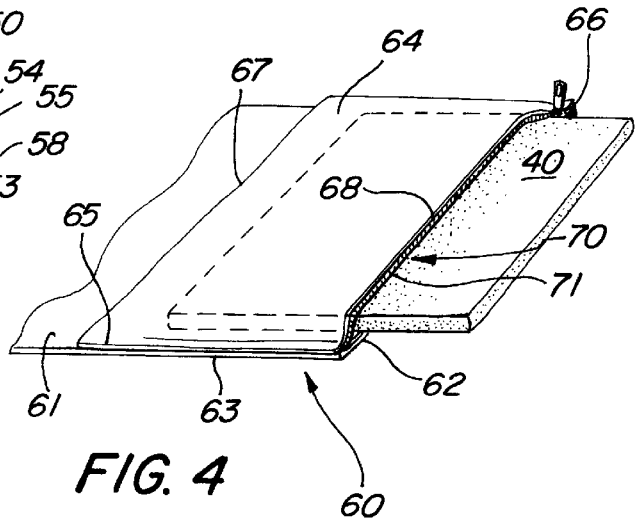
FIG. 4 sets forth a partial perspective view of a further alternate embodiment of the present invention showing the use of a side insertion opening for the bedsheet pocket and further showing a zipper-type fastener for closure thereof.

FIG. 4 sets forth a partial perspective view of a further alternate embodiment of the present invention generally referenced by numeral 60 which includes a zipper fastened opening formed along the side edge of the pocket cover. More specifically, bedsheet and blanket combination 60 includes a generally planar undersheet 61, a pocket cover 64 which overlies approximately half of undersheet 61 and a generally rectangular blanket 40 in the configuration of bedsheet and blanket combination 60, edge 63 of undersheet 61 and edge 65 of pocket cover 64 are joined using conventional fabrication techniques. Similarly, while not seen in FIG. 4, it will be understood that side edge 67 of pocket cover 64 is similarly joined to the underlying portion of undersheet 61 and further the upper edges of pocket cover 64 and undersheet 61 are also joined forming a joint 66 therebetween. Edges 62 and 68 support respective half portions of conventional zipper 71. Thus, zipper 71 includes separatable portions secured to edges 62 and 68. In the position shown in FIG. 4, zipper 71 is moved to the open position forming opening 70 between pocket cover 64 and undersheet 61. As a result, blanket 40 may be inserted through opening 70 and secured therein by drawing zipper 71 downwardly to its position of closure.

Once again, the configuration of FIG. 4 will be understood to provide the above-described advantages as to operation and maintenance of the present invention bedsheet and blanket combination.

Figure 5:
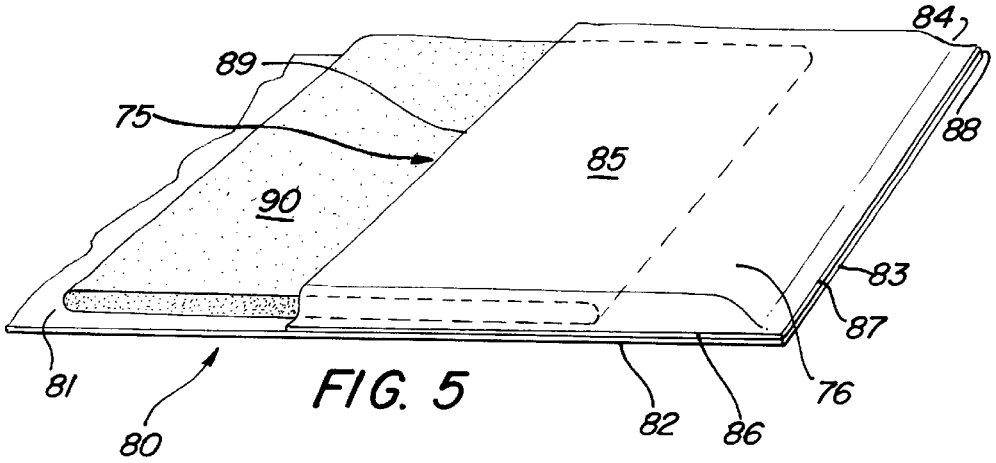
FIG. 5 sets forth a partial perspective view of a still further alternate embodiment of the present invention having the blanket portion inserted through a top to bottom interior opening of the bedsheet portion.

FIG. 5 sets forth a partial perspective view of a still further alternate embodiment of the present invention generally referenced by numeral 80. Bedsheet and blanket combination 80 is substantially identical to bedsheet and blanket combination 10 (seen in FIG. 1) with the difference being found in the provision of a pocket opening in the center or middle seam of the combination. Accordingly, bedsheet and blanket combination 80 includes a generally planar undersheet 81 having edge portions 82, 83 and 84 together with an interior edge 89. A pocket cover 85, also formed of a conventional bedsheet material or the like, includes a bottom edge 86 joined to edge portion 82, a side edge 81 joined to edge 83, and an upper edge 88 joined to edge portion 84 of undersheet 81. Edge 89 of pocket cover 85 is not attached and thus an opening 75 is formed between edge 89 and undersheet 81. As a result, a pocket 76 is formed upon undersheet 81 having a center opening 75 for receiving a blanket 90.

Figure 6:
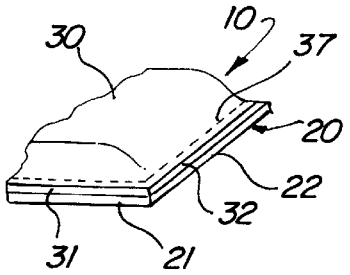
FIG. 6 sets forth a partial perspective view of the sewn attachment of the outer edges for the present invention bedsheet.
Figure 7:
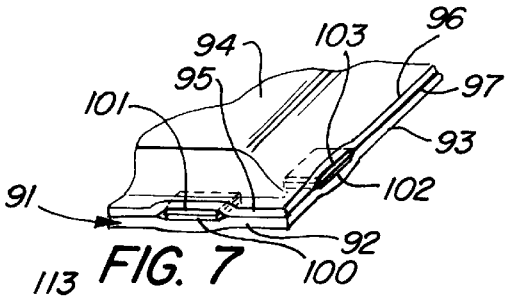
FIG. 7 sets forth a partial perspective view of an alternate embodiment of the present invention having a different attachment means between the layers of the bedsheet used in the inventive combination.

Thus, it will be apparent to those skilled in the art that examination of FIGS. 1 through 5 as thus described set forth generally similar embodiments of the present invention with the primary differences being found in the location of the pocket opening which receives the inserted blanket. FIGS. 6 and 7 set forth partial section views of alternative attachment apparatus utilized in joining the pocket cover to its respective undersheet in order to form the three-sided pocket of the invention.

More specifically, FIG. 6 sets forth a partial perspective view of one corner of bedsheet and blanket combination 10. As described above, combination 10 includes a pocket cover 30 having edge portions 31 and 32 received upon an undersheet 20 having edge portions 21 and 22. As is further described above, attachment is provided between overlying edges on three sides of pocket cover 30 to form the blanket receiving pocket. In the example shown in FIG. 6, conventional sewn seams such as seam 37 are used to join the overlying layers of undersheet and pocket cover 30. As mentioned above, it will be apparent to those skilled in the art that other forms of attachment may be utilized without departing from the spirit and scope of the present invention. Certain suggested ones of the alternative attachment apparatus are mentioned above. The important feature of such attachment apparatus is the formation of the blanket retaining pocket.

FIG. 7 sets forth a still further alternate embodiment of the present invention with the difference being found in the use of discrete fasteners having a removable or releasible attachment. Thus, for example, a pocket cover 94 having edge portions 95 and 96 overlies an undersheet 91 having edge portions 92 and 93. A pair of cooperating fasteners 100 and 101 are secured along edge 92 and 95 respectively. Similarly, a pair of cooperating fasteners 102 and 103 are secured along edges 93 and 96. Fasteners 100 and 101 as well as fasteners 102 and 103 may utilize a variety conventional attachment apparatus in which a pair of cooperating fastener members may be removably joined. Thus, for example, fasteners 100, 101, 102 and 103 may comprise hook and loop fabric attachment pads cooperating for attachment or alternative mechanical apparatus such as snap connectors or the like.

Figure 8:
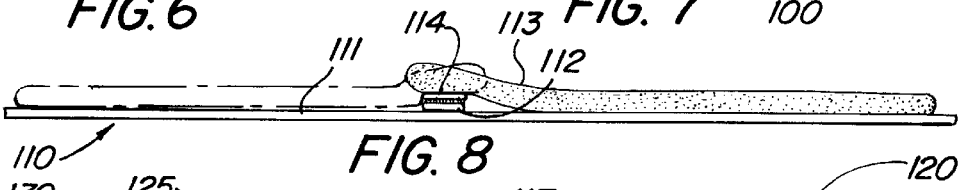
FIG. 8 sets forth a section view of a still further alternate embodiment of the present invention bedsheet and blanket combination.

FIG. 8 sets forth a still further alternate embodiment of the present invention generally referenced by numeral 110. Bedsheet and blanket combination 110 is shown in profile from the bottom edge thereof. It will be understood, however, that the same profile is provided when bedsheet and blanket combination 110 is viewed in profile from its upper edge. Bedsheet and blanket combination 110 includes a generally planar undersheet 111 supporting an elongated fastener 112 which extends through the approximate middle of undersheet 11. Combination 110 further includes a blanket 113 having a width approximately half of the width of undersheet 111. Blanket 113 supports an elongated fastener 114 which overlies and cooperates with fastener 112. As a result, blanket 113 is secured upon undersheet 111 to provide an insulative enhancement for the person sleeping beneath the right hand portion of bedsheet and blanket combination 110 and a reduced thermal insulation for the user sleeping under the left hand portion thereof. Fasteners 112 and 114 may, for example, comprise elongated strips or multiple pads of conventional hoop and loop fabric attachment devices. In the embodiment of FIG. 8, blanket 113 is simply removed from undersheet 111 to provide laundering and convenient handling of undersheet 111 and to avoid the need for washing or laundering blanket 113 each time undersheet 11 is laundered. For purposes of illustration, blanket 113 is shown in dashed-line reverse position in which blanket 113 and fastener 114 are rotated to oppositely position blanket 113 upon undersheet 111.

Figure 9:
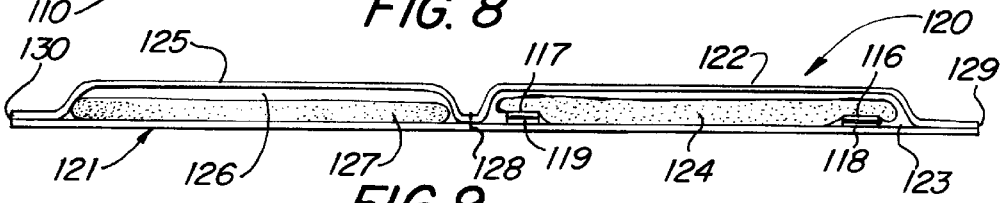
FIG. 9 sets forth a section view of a still further alternate embodiment of the present invention bedsheet and blanket combination.

FIG. 9 sets forth a section view of a still further alternate embodiment of the present invention generally referenced by numeral 120. FIG. 9 shows a section view of bedsheet and blanket combination 120 taken along similar section lines shown as 2—2 in FIG. 1 for combination 10. The primary difference between bedsheet and blanket combination 120 and combination 10 shown in FIG. 1 is the provision of a section blanket receiving pocket giving the user a pocket for meeting the preference of each person sleeping with the bedsheet and blanket combination. More specifically, combination 120 includes a generally planar undersheet 121 having a pocket cover 122 and pocket cover 125 secured thereto. In the most likely fabrication of bedsheet and blanket combination 120, pocket covers 122 and 125 are formed of a single planar unit and are joined at a seam 128 at the approximate middle thereof to form separate pockets 123 and 126. The remaining fabrication of bedsheet and blanket combination 120 is substantially the same as that set forth above. Thus, for example, pocket cover 122 is sewn or otherwise joined to undersheet 121 to form a joint 129 while pocket cover 125 is sewn or otherwise joined to undersheet 121 to form a joint 130. Thus, with a pair of pockets 123 and 126 formed therein, bedsheet and blanket combination 120 is able to accommodate blankets such as blankets 124 and 127 having the desired thickness for each sleeping person. In the example shown in FIG. 9, blanket 127 is substantially thinner and therefore cooler than blanket 124. It will be apparent to those skilled in the art that a plurality of blankets may be used within either/or or both of pockets 123 and 126. FIG. 9 also shows an embodiment of the invention having cooperating pairs of fasteners similar to the fastener pairs shown in the embodiment of FIGS. 1 and 2. In combination 120 however, fasteners such as 116 and 117 are secured to the underside of blanket 124 while fasteners such as fasteners 118 and 117 are secured upon undersheet 121. The function of such fasteners remains the same as described above. The fasteners secure the blanket within the pocket.

Figure 10:
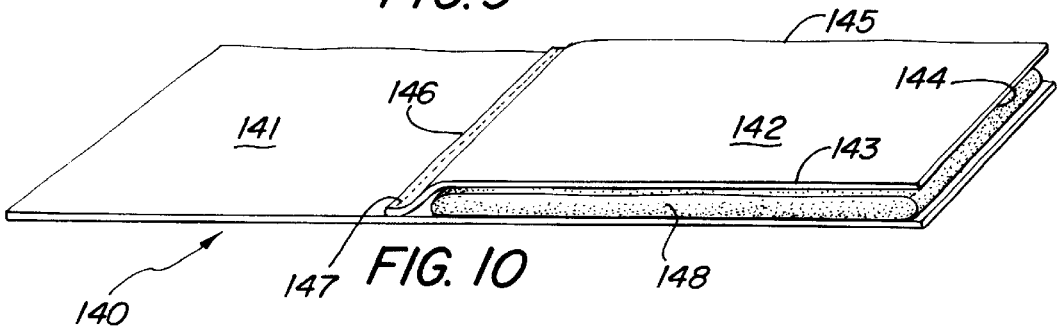
FIG. 10 sets forth a perspective view of a still further alternate embodiment of the present invention bedsheet and blanket combination.

FIG. 10 sets forth a perspective view of a still further alternate embodiment of the present invention generally referenced by numeral 140. Bedsheet and blanket combination 140 provides a "pageable book" type embodiment in which a generally planar undersheet 141 supports a pocket cover 142 in a book page like attachment. Accordingly, pocket cover 142 defines an edge 146 which is joined to the approximate middle of undersheet 141 by attachment such as a sewn seam 147. Pocket cover 142 further defines a bottom edge 143, a side edge 144 and a top edge 145 each of which is nonattached to the corresponding edges of undersheet 141. As a result, pocket cover 142 may be moved in the same manner as a book page is moved between the covers of its supporting book. In the use of bedsheet and blanket combination 140 shown in FIG. 10, a blanket 148 is supported between pocket cover 142 and the underlying portion of undersheet 141. It may be further desirable in the fabrication of bedsheet and blanket combination 140 to provide one or more attachment points about edges 143, 144 and 145 (attachments not shown) which would function in a similar manner to fasteners 100 through 103 shown in FIG. 7. In any event, the use of bedsheet and blanket combination 140 provides the above-described benefits of reducing the need to frequently wash blanket 148 due to its removable characteristic.

What has been shown is a bedsheet and blanket combination system in which a pocket or other retaining enclosure is provided upon approximately one-half of the combination for receiving a blanket in a removable manner. The removable support of the blanket with respect to the remainder of the combination facilitates removal of the blanket for easier washing and laundering of the remaining elements of the combination.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. In a bed having a sleeping surface for use by two persons, a bedsheet and blanket combination comprising:

a generally planar undersheet formed of a thin flexible fabric material;

a pocket cover overlying substantially one-half of said undersheet, said pocket cover and said undersheet being joined to form a three-sided pocket having a blanket opening therein; and a blanket having a size and shape facilitating insertion of said blanket through said blanket opening into said pocket and removal of said blanket out of said pocket through said blanket opening, said blanket and said pocket extending over approximately one-half of said undersheet and covering one of two persons sleeping in a bed and said blanket being removable from said three-sided pocket to allow said undersheet and pocket to be laundered without said blanket.

2. The combination set forth in claim 1 wherein said blanket, said undersheet and said pocket cover are generally rectangular.

3. The combination set forth in claim 2 wherein said undersheet defines an approximate center and first, second and third edges and wherein said pocket cover defines fourth, fifth, sixth, and seventh edges respectively overlying said center and said first, second and third edges.

4. The combination set forth in claim 3 wherein said center, said first edge and said second edge of said undersheet are joined respectively to said fourth, fifth, and sixth edges of said pocket cover.

5. The combination set forth in claim 3 wherein said first, second and third edges are joined to said fifth, sixth, and seventh edges respectively.

6. The combination set forth in claim 3 wherein said first edge, said third edge and said center are joined to said fifth, seventh and fourth edges respectively.

7. The combination set forth in claim 1 wherein said pocket cover and said undersheet are joined using a sewn seam.

8. The combination set forth in claim 1 wherein said pocket cover and said undersheet are joined using a plurality of attachments.

9. The combination set forth in claim 1 wherein said blanket opening includes closure means for closing said blanket opening.

10. The combination set forth in claim 9 wherein said closure means includes a zipper.

11. The combination set forth in claim 9 wherein said closure means includes a hook and loop fabric attachment.

* * * * *